United States Patent [19]

Weisner et al.

[11] Patent Number: 4,787,228

[45] Date of Patent: Nov. 29, 1988

[54] MAKING MOLDS WITH RECTANGULAR OR SQUARE-SHAPED CROSS SECTION

[75] Inventors: Eike Weisner, Windeck; Horst Gravemann, Osnabrück, both of Fed. Rep. of Germany

[73] Assignee: Kabel-und Metallwerke Gutehoffnungshuette AG, Hanover, Fed. Rep. of Germany

[21] Appl. No.: 493,515

[22] Filed: May 12, 1983

[30] Foreign Application Priority Data

May 13, 1982 [DE] Fed. Rep. of Germany ..... 3218100

[51] Int. Cl.[4] ..... B21D 31/00; B21C 1/24

[52] U.S. Cl. ..... 72/47; 29/421.2; 72/370; 72/283; 164/418

[58] Field of Search ..... 29/421 E; 72/46, 47, 72/283, 700, 370; 164/138, 418

[56] References Cited

U.S. PATENT DOCUMENTS

| | | | |
|---|---|---|---|
| 1,922,770 | 8/1933 | Kornbrath | 72/282 X |
| 3,811,311 | 5/1974 | Barone et al. | 72/47 X |
| 3,990,498 | 11/1976 | Dompas et al. | 164/418 X |
| 4,037,646 | 7/1977 | Hara et al. | 164/418 |
| 4,052,784 | 10/1977 | Diepers et al. | 72/47 X |
| 4,081,983 | 4/1978 | Shrum | 29/421 E |
| 4,144,993 | 3/1979 | Ushio et al. | 164/418 X |
| 4,197,902 | 4/1980 | Von Jan et al. | 164/418 |
| 4,220,027 | 9/1980 | Johnson et al. | 29/421 E |

FOREIGN PATENT DOCUMENTS

| | | | |
|---|---|---|---|
| 2940357 | 4/1981 | Fed. Rep. of Germany | 72/283 |
| 445488 | 10/1974 | U.S.S.R. | 72/283 |
| 1245833 | 9/1971 | United Kingdom | 72/258 |

*Primary Examiner*—E. Michael Combs

*Attorney, Agent, or Firm*—Ralf H. Siegemund

[57] ABSTRACT

A round copper or copper-alloy tube is internally coated with a relatively thick nickel or nickel-alloy layer and formed into a tube of rectangular or square-shaped cross section; the tube or cut-off sections thereof will serve as molds for continuous casting.

6 Claims, No Drawings

MAKING MOLDS WITH RECTANGULAR OR SQUARE-SHAPED CROSS SECTION

BACKGROUND OF THE INVENTION

The present invention relates to a method for manufacturing a mold for continuous casting of high melting metals such as steel, the mold is to have rectangular and here particularly square-shaped cross section.

Molds of the type to which the invention pertains are usually made of copper or a copper alloy and carry a wear-resisting coating on the inside i.e. on the surface facing the molten material. Such a mold has to have a very high thermal conductivity, particularly when processing high melting metal such as iron and steel, so that the heat content of the molten material can be reduced as rapidly as possible. The wall thickness of such a mold has to be at least as large as is required for reasons of mechanical stability under particular consideration of mechanical loads in general.

Since copper has a very high thermal conductivity, its use for molds for continuous casting is preferred. On the other hand, the mechanical properties of copper are usually insufficient, and it is for this reason that recently, molds for continuous casting employ low alloyed copper alloys so that the mechanical properties of the mold can be improved. Such a copper alloy has, however, a somewhat reduced thermal conductivity, but in the overall balance, copper alloys constitutes a preferred material for making such molds.

It was found, however, that the continuous casting of certain kinds of steel using copper or copper alloy molds, dissolve some of the copper, i.e. some of the copper molecules are included in this steel resulting in a grain boundary diffusion and that, in turn, may lead to the infamous red shortness of the steel. For this reason, it has been proposed to cover the interior surface of the mold, i.e. that surface which engages the molten metal, with a wear resisting coating preventing the diffusion of copper molecules into the steel. Such a coating should increase the wear resistance of the mold and therefore increase its life. Moreover, friction between the casting and the mold should be reduced so that the mold can be operated at a higher casting speed.

It has been proposed to electrolytically deposit a chromium or nickel coating upon the inside surface of a mold so as to protect the mold surface against the melt in the stated manner. Layers of this kind are wear resisting and establish a low friction between the molten solidifying material in the mold, and the mold itself. It was found, however, that the manufacture of mold with rectangular or square-shaped cross section is rendered difficult for the following reasons.

A uniform coating of the corners, i.e. of the sharply curved portions of the mold is not possible because the throwing power of the electrolytic bath is relatively poor. This means that the overall thickness of the coating has to be very high, i.e. higher on the average, in order to make sure that the corners are adequately covered. However, when the protective coating exceeds about 150 micrometers, then the internal contour of the mold is changed such that casting is no longer possible. This is known in the industry as the keyhole effect.

DESCRIPTION OF THE INVENTION

It is an object of the present invention to provide a new and improved method for making a mold for continuous casting, particularly a mold having a rectangular or square-shaped cross section obviating the difficulties outlined above.

It is a particular object of the present invention to provide a new and improved method for making a mold for continuous casting having a rectangular or square-shaped cross section and carrying on the inside an electrolytically deposited, wearproof layer with a wall thickness of at least 150 micrometers or more.

In accordance with the preferred embodiment of the present invention, it is suggested to provide a round tube, preferrably a copper or copper alloy tube, by means of press working and/or rolling and/or drawing; a layer is electrolytically deposited as a coating upon the inside surface of the tube; the layer being of a wear resisting material. Subsequently this round compound tube is reworked into a tube of rectangular or square-shaped cross section.

It was surprisingly found that the reworking of the compound tube into a quadrilateral cross section does not detrimentally effect the electrolytically deposited layer; rather, this layer behaves in exactly the same manner as the copper tube, i.e. the reworking effects the substrate tube and the deposited layer equally so that even after the reworking, the thickness of the coating remains uniform, particularly within the more or less sharply curved corners. Preferably, the compound tubing, i.e. the tube with internal coating, is annealed at 500 to 1,000° C. prior to the reworking in order to set up a diffusion layer in the interface region between the copper tube and the deposited coating. In case the annealing affects the dimensions of the tube, a subsequent cold working for sizing the tube may be required.

In the preferred form of practising the invention, the copper or copper-alloy tube is coated on the insde with a coating of at least 150 micrometers by means of a nickel layer. Nickel is preferred over chromium because for mechanical reasons an electrolytically produced chromium layer can not be cold worked. It has to be observed, however, that nickel is less hard than chromium, and hardness is the main feature providing wear resistance and abrasion proofing of the layer. However, if one uses nickel, this lesser or lower hardness can be compensated by adding certain solid particles to the electrolytic bath, for example, silicon carbide particles. During the electrolytic depositing process, these solid particles are embedded in the crystal structure of the nickel and these inclusions increase considerably the strength of the nickel layer; the thermal conductivity is only insignificantly reduced by the inclusions.

It was found that the wall thickness of the deposited layer should be at least 150 micrometers and can be as thick as 4 millimeters. The choice of the layer thickness depends on the expected wear conditions and the wide range from which the thickness can be selected permits ready adaptation of the mold to practical conditions and considerations. If the coating is sufficiently thick, it may even permit reworking of the mold after it has been used for a certain period of time.

The working of the round compound tube into a tube of rectangular or square shaped cross section is preferably carried out by means of drawing under utilization of an appropriate annular die and a mandrel. This way one obtains a uniform reduction, or better, rate of reduction of the wall thickness of the tube as well as of the wear resisting coating. Therefore, the drawing and sizing will indeed produce a mold having the desired dimensions. If a particularly high accuracy is required as far as the mold is concerned, it may be desirable to resize the tube after the drawing by means of explosion forming. In this case, a mandrel with rectangular or square shaped cross section is inserted into the interior of the tube and by means of an externally applied explosion, the tube material is formed onto the mandrel. Conceivably, one may employ a curved mandrel in order to obtain a curved mold. Alternatively, a curved mold may be produced by forming a regularly curved mandrel into a predrawn tube; the mandrel has a rectangular or square shaped cross section, and subsequently the tube and the mandrel are forced together through an appropriately shaped die.

A particular economic procedure is to be seen in the following. One may begin with a tube, i.e. a copper or copper alloy tube having a considerably thicker wall, or a considerably larger length than the mold to be made will ultimately have. This thick and/or long tube is electrolytically coated on the inside, and the coated tube is worked into a tube with rectangular or square shaped cross section; subsequently this long tube (long because it was originally long or because the drawing made it so) will be cut into mold tubes at the desired length. The electrolytic process is a time consuming one but if the tube worked is long or will be made long, electrolytic deposit will be carried out only once for a plurality of mold tubes. Of course, if the tube is thick and will be reduced in wall thickness by stretching, then the wall thickness of the electrolytic layer has to be thicker accordingly because its thickness is likewise reduced by the drawing process. This, of course, has to be observed whenever for any reason, subsequent working is expected to reduce the wall thickness of a tube.

The electrolytically coated round tube may preferably, in all cases, be drawn for purposes of reducing the cross-sectional dimension and in one or in several working steps. The reforming into a tube of rectangular or square shaped cross section is carried out subsequently. The above mentioned diffusion annealing may be an intermediate annealing step being interposed in between two sequential drawing steps as described. Annealing may be carried out as a last step prior to reforming the tube into one of rectangular or square shaped cross section.

The invention should be explained more fully by way of the following specific examples constituting best modes of practicing the preferred embodiment of the invention. One may begin with a copper tube having a length of 850 millimeter; a wall thickness of 10.5 millimeter; and an outer diameter of 189 millimeter. This tube is electrolytically coated with nickel in an electrolytic bath to obtain an internal coating of 950 micrometers. The copper tube serves as cathode in this electrolytic process while an anode is disposed in the axis of the tube in order to ensure uniform coating of the entire internal surface of the copper tube.

The outer tube surface is not to be coated nor are the axial end faces of the tube. Therefore, these surfaces are previously coated with a lacquer or the like which is not electrically conductive. After the tube has been coated at the desired wall thickness, depending upon the degree of wear resistance that is required, one will remove the tube from the electrolytic bath. A suitable machine such as a press working machine with brackets forms the round tube into a tube with rectangular or square shaped cross section. This preformed tube will now receive a mandril. For example, a curved conical mandril with corresponding rectangular or square shaped cross section is forced and driven into the tube and subsequently tube and mandril are forced through a die in order to provide the final dimension. The completed mold tube may have the following dimensions: the internal contour may be a rectangle, 138 millimeters by 122.6 millimeters and a wall thickness of 7.7 millimeters, a total length of 801 millimeters, and a radius of overall curvature (of the axis) of 4,939 millimeter. The residual nickel layer may be 700 micrometers.

A second example uses a copper tube having a length of 2.1 meters, an outer diameter of 300 millimeter and a wall thickness of 24 millimeter. The inner surface of that tube is electrolytically coated by means of a nickel layer having a layer thickness or wall thickness of 1,300 micrometers. This compound tube is drawn in several steps by means of a mandrel and one or more dies to obtain a round tube with an outer diameter of 277.8 millimeter and a wall thickness of 22 millimeter. Thereafter the tube is annealed for several hours by 650° C. so as to establish a diffusion layer between the copper tubing and the nickel layer. A mandrel with rectangular cross section is introduced into the annealed tube and the latter is drawn through a die with rectangular cross section. The resulting tube has dimensions of 214.4 millimeter by 150.4 millimeter at the outside, and the inside dimensions are 194.2 millimeter by 130.2 millimeter. the resulting nickel layer has a thickness of about 1,028 micrometers.

Sections were cut from this tube at the length of the desired mold and a conical curved mandril with rectangular cross section was forced into each of the sections. The mold wall in each instance was then formed onto the mandril by means of explosion forming. Alternatively, however, this last forming step may also be carried out by forcing each mold tube section with inserted curved mandril through an appropriate die.

Both examples can be modified in that in lieu of a pure nickel layer, a nickel-alloy may be electrolytically deposited upon the inner surface of the copper tube. For instance, silicon carbide dust may be added to the electrolyte, and silicon carbide particles will be embedded into the nickel matrix as it is formed during the electrolytic process. In cases, a tubular mold is required to be provided with a flange. Preferably, a separate flange piece will be secured to one end of the mold tube after it has been formed into the desired rectangular or square shaped cross sectional configuration. Welding is preferably carried out by means of electron beams.

The invention is not limited to the embodiments described above, but all changes and modifications thereof, not constituting departures from the spirit and scope of the invention are intended to be included.

We claim:

1. A method for making a tubular mold having rectangular or square shaped cross section to be used for continuous casting of high melting metals such as steel comprising the steps of:

providing a round tube made of copper or a copper alloy by means of press working and/or rolling and/or drawing;

electrolytically depositing a wear resisting coating on the inside surface of the round tube as made to produce a compound tube having a wear resisting uniform coating on the inside; and subsequently forming the round tube into a tube with rectangular or square-shaped cross section.

2. A method as in claim 1 wherein said electrolytically depositing step is continued until coating of at least 150 micrometers is obtained.

3. A method as in claim 1 wherein said forming step includes insertion of mandrel having rectangular or square shaped cross section and drawing the compound tube through a correspondingly contoured die.

4. A method as in claim 3 and including the additional step after said forming step by means of drawing, of sizing the tube through explosion forming.

5. A method as in claim 3 and including the subsequent step of inserting a curved mandrel with a rectangular or square shaped cross section into the tube and forcing the tube and mandrel together through a die.

6. A method as in claim 1 wherein said copper tubing has considerably thicker wall thickness and/or is longer than the mold to be made, and including the additional step of cutting said rectangular or square shaped tube into sections of desired length.

* * * * *